US012428214B2

(12) United States Patent
Konandreas

(10) Patent No.: US 12,428,214 B2
(45) Date of Patent: Sep. 30, 2025

(54) RECEPTACLE ACCESSORY FOR FITTING ON A PACKAGE OF CONSUMER GOODS

(71) Applicant: Philip Morris Products S.A., Neuchatel (CH)

(72) Inventor: Stefanos Konandreas, Geneva (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/704,580

(22) PCT Filed: Oct. 27, 2022

(86) PCT No.: PCT/EP2022/080091

§ 371 (c)(1),
(2) Date: Apr. 25, 2024

(87) PCT Pub. No.: WO2023/078775

PCT Pub. Date: May 11, 2023

(65) Prior Publication Data

US 2025/0122003 A1 Apr. 17, 2025

(30) Foreign Application Priority Data

Nov. 5, 2021 (EP) ..... 21206808

(51) Int. Cl.
*B65D 85/10* (2006.01)

(52) U.S. Cl.
CPC ..... *B65D 85/1081* (2013.01); *B65D 85/1056* (2020.05); *B65D 2209/00* (2013.01)

(58) Field of Classification Search
CPC ..... B65D 85/10; B65D 85/1045; B65D 85/1056; B65D 85/1081; B65D 2209/00

(Continued)

(56) References Cited

U.S. PATENT DOCUMENTS 1,341,295 A * 5/1920 Burtis ..... A24F 23/04 206/267
5,992,621 A 11/1999 Grant et al.
(Continued)

FOREIGN PATENT DOCUMENTS

CN 201040642 Y * 3/2008
DE 296 15 838 U1 10/1996
WO WO 2015/197864 A1 12/2015

OTHER PUBLICATIONS

International Search Report & Written Opinion issued Feb. 27, 2023 in PCT/EP2022/080091, filed on Oct. 27, 2022, 11 pages.
(Continued)

*Primary Examiner* — Bryon P Gehman
(74) *Attorney, Agent, or Firm* — Oblon, McClelland, Maier & Neustadt, L.L.P.

(57) ABSTRACT

A receptacle accessory for fitting on a package for consumer goods is provided, the package having a body portion and a lid portion hingedly attached to the body portion, the receptacle accessory including: a cap portion configured to receive and releasably retain the lid portion of the package by an interference fit, the cap portion including a front wall, a rear wall, and a lateral top wall connecting the front wall and the rear wall; and a compartment configured to receive and retain used consumer goods, the compartment being disposed on a face of the front wall facing away from the rear wall. There is also provided a system including a package for consumer goods having a body portion and a lid portion hingedly attached to the body portion along a hinge line, and the receptacle accessory.

15 Claims, 5 Drawing Sheets

(58) Field of Classification Search
USPC ..... 206/246, 256, 265–275, 566
See application file for complete search history.

(56) References Cited

U.S. PATENT DOCUMENTS

2005/0274633 A1* 12/2005 Ako ..... B65D 85/1045
206/242
2016/0090230 A1 3/2016 Dong

OTHER PUBLICATIONS

European Search Report issued May 2, 2022 in EP application 21206808.4, filed on Nov. 5, 2021, 6 pages.
Russian Office Action issued Jun. 24, 2024 in Russian Patent Application No. 2024115230/20, 3 pages.

* cited by examiner

RECEPTACLE ACCESSORY FOR FITTING ON A PACKAGE OF CONSUMER GOODS

The present disclosure relates to a receptacle accessory for fitting on a package for consumer goods, and to a system comprising a receptacle accessory releasably fitted on a package for consumer goods. In particular, but not exclusively, the receptacle accessory finds particular application as a receptacle for storing used aerosol-generating articles or components of used aerosol-generating articles. The package may be a package for unused aerosol-generating articles. The package may be full of unused aerosol-generating articles, partially full of unused aerosol-generating articles, or empty of unused aerosol-generating articles.

It is known to provide consumer goods, for example aerosol-generating articles shaped as rods, in portable packages having a lid portion hingedly attached to a body portion. An example of such a package is the Flip Top® package. The consumer goods are aligned parallel to each other in the package, and may be individually removed after tilting the lid about the hinged connection to an open position so as to allow a user to grasp an exposed end of one of the consumer goods and withdraw the consumer good from the package.

Where the consumer goods are aerosol-generating articles, for example heat-not-burn articles in which an aerosol-generating substrate is heated so as to release an aerosol, a user may wish to dispose of used aerosol-generating articles in a responsible manner.

According to a first aspect of the present invention, there is provided a receptacle accessory for fitting on a package for consumer goods, the package having a body portion and a lid portion hingedly attached to the body portion, wherein the receptacle accessory comprises a cap portion configured to receive and releasably retain the lid portion of the package by an interference fit, the cap portion comprising a front wall, a rear wall and a lateral top wall connecting the front wall and the rear wall, and wherein the receptacle accessory further comprises a compartment configured to receive and retain used consumer goods, the compartment being disposed on a face of the front wall facing away from the rear wall.

The receptacle accessory may be configured as a reusable accessory. When fitted on the package for consumer goods, the receptacle accessory may not significantly add to the bulk of the package. When fitted to the package for consumer goods, the cap portion of the receptacle accessory may be configured to allow the lid portion of the package to be opened by hinging relative to the body portion of the package. The receptacle accessory may pivot with the lid portion relative to the body portion of the package when the lid portion is opened and closed.

The compartment of the receptacle accessory provides a convenient volume for temporary storage of used consumer goods until such time that the used consumer goods can be disposed of in a responsible manner. Once the package is empty after all the consumer goods have been used up, the receptacle accessory can then be fitted on a new package of fresh consumer goods.

Used aerosol-generating articles may contain components that can usefully be recycled, such as for example polylactic acid components, cellulose components, and metal components.

The cap portion may be configured to have a cup shape that is complementary to a shape of the lid portion of the package for consumer goods. For example, where the lid portion of the package is shaped as a rectangular prism or a trapezoidal prism, the cap portion may have a complementary cup shape. The cap portion is configured to receive and releasably retain the lid portion by an interference fit.

In some embodiments, the cap portion further comprises at least one side wall connecting an end of the front wall to a corresponding end of the rear wall.

In some embodiments, the cap portion further comprises first and second side walls each connecting respective first and second ends of the front wall to corresponding first and second ends of the rear wall.

The cap portion may form a cup shape that is closed on all sides except for a mouth that receives the lid portion of the package. This can help to keep the lid portion securely engaged in the cap portion.

Alternatively, the cap portion may be open on at least one side in addition to the mouth, in which case the cap portion may be slid laterally onto the lid portion of the package for consumer goods. The cap portion may comprise just the front wall and the rear wall joined by the lateral top wall. This can allow for an easier fitting of the receptacle accessory on the lid portion of the package.

At least one interior surface of the cap portion, for example an interior surface of the front wall, an interior surface of the rear wall, an interior surface of a side wall, or interior surfaces of any combination of the front wall, the rear wall and the side wall(s), may be provided with a non-slip surface coating or non-slip surface features to help improve the interference fit between the interior surface of the cap portion and an exterior surface of the lid portion. A non-slip surface coating may be a coating having a friction coefficient higher than a friction coefficient of an exterior surface of the receptacle accessory. Non-slip surface features may comprise a roughening or texturing of at least portions of the interior surface so as to increase the friction coefficient of the interior surface.

The front wall of the cap portion may extend further than the rear wall from the lateral top wall. This can be useful where the lid portion of the package has a front wall that extends further than a rear wall of the lid portion from a top of the lid portion. In this way, the configuration or shape of the cap portion is made similar corresponding to the configuration or shape of the lid portion.

When the cap portion of the receptacle accessory is fitted on the lid portion of the package, the lid portion of the package can only be freely opened if the rear wall of the cap portion does not extend beyond and cover a hinge line where the lid portion of the package is hingedly attached to the body portion of the package. It may be desirable for the rear wall of the cap portion to cover the hinge line when the lid portion of the package is fully inserted into the cap portion of the receptacle accessory, thus preventing the lid portion from being pivotable with respect to the body portion of the package. This can help to keep the lid portion of the package closed when the package is being transported in a user's pocket or handbag. A user may slidably raise the cap portion of the receptacle accessory by a predetermined distance relative to the lid portion of the package so that the rear wall of the cap portion uncovers the hinge line, thus allowing the lid portion to be pivoted freely about the hinge line in order to permit access to consumer goods within the package.

The compartment of the receptacle accessory may have a rear wall formed by the front wall of the cap portion, a front wall, a lateral top wall connecting the rear wall and the front wall, and a pair of side walls. The compartment may be open at a lower end to receive used consumer goods.

The compartment may be provided with a plurality of substantially parallel longitudinal ridges to define a plurality of substantially parallel spaces within the compartment.

Each space may be configured to interference fit with a used consumer good when received in the space such that the used consumer good is securely held within the space.

The compartment may be configured to provide a convenient temporary storage for used consumer goods. The ridges and spaces, where provided, may help to retain the used consumer goods within the compartment so that they do not easily fall out of the compartment.

There may be provided a concave arcuate surface between each adjacent pair of ridges. The concave arcuate surface may be configured to be complementary to an arcuate surface of a cylindrical used consumer good. In this way, an interference fit of used consumer goods in the compartment may be improved, since a greater proportion of a surface of each used consumer good will be in contact with an interior surface of the compartment.

Each space may have a closed end proximate the lateral top wall of the cap portion. The closed end of each space may be configured to hold a portion of a used consumer good in a substantially airtight manner. This can be useful in reducing release of unwanted odours from used consumer goods when temporarily stored in the compartment. For example, where the consumer goods are aerosol-generating articles, they may be formed as rods comprising an aerosol-generating substrate towards one end, and a filter at the other end. Used aerosol-generating articles can be inserted into the container such that the end comprising the aerosol-generating substrate is within the closed end of its respective space, and the filter can act as a plug or seal to reduce the release of unwanted odours from the aerosol-generating substrate from the compartment.

The ridges may define at least 10 substantially parallel spaces within the compartment.

The ridges may define at least 20 substantially parallel spaces within the compartment.

Generally, it is preferred that the ridges define sufficiently many spaces within the compartment to store all of the consumer goods that are contained within the package for consumer goods. For example, for a package of 10 aerosol-generating articles, the container may have 10 spaces. For a package of 20 aerosol-generating articles, the container may have 20 spaces. For a package of N aerosol-generating articles, the container may have N spaces, where N is a positive integer.

The ridges may be provided on the rear wall of the compartment facing the front wall of the compartment.

The ridges may be provided on the front wall of the compartment facing the rear wall of the compartment.

The ridges may be provided on mutually facing surfaces of both the front wall and the rear wall of the compartment.

At least one interior surface of the compartment may be provided with a non-slip surface coating or non-slip surface features to help retain used consumer goods within the compartment. The non-slip surface coating or non-slip surface features may improve the interference fit between the used consumer goods and the interior surface of the compartment. A non-slip surface coating may be a coating having a friction coefficient higher than a friction coefficient of an exterior surface of the receptacle accessory. Non-slip surface coatings are commercially available, and may be applied as coatings of polymer-based adhesive, optionally in a solvent, or coatings of grit or wood particles or other rough-textured components in an adhesive and optionally a solvent. Non-slip surface features may comprise a roughening or texturing of at least portions of the interior surface so as to increase the friction coefficient of the interior surface.

The front wall of the cap portion may comprise the rear wall of the compartment.

The front wall of the compartment may extend further than the rear wall of the compartment from the lateral top wall. In such examples, the compartment may be open on a side that faces the body portion of the package when the receptacle accessory is fitted on the package. A surface of the body portion of the package can then serve as a rear wall of the compartment while the receptacle accessory is fitted on the package. Used consumer goods stored in the compartment can be more easily accessed for disposal by removing the accessory receptacle from the package so as to expose the open side of the compartment.

The front wall of the compartment may extend substantially the same distance as the rear wall of the compartment from the lateral top wall. This may allow more secure temporary storage of used consumer goods in the compartment since they can be held along their entire lengths between the front and rear walls of the compartment.

The compartment may be provided with a ribbon configured to be pulled for facilitating ejection of used consumer goods from the compartment. The ribbon may be made of a flexible polymer material, for example an extruded polymer material. The ribbon may comprise woven or non-woven threads or fibres, for example of cotton or synthetic polymer. In some embodiments, the ribbon may be made of cellulosic fibres. The ribbon is flexible. Preferably, the ribbon is substantially inelastic in a longitudinal direction. In other words, the ribbon preferably does not stretch appreciably when pulled.

One end of the ribbon may be attached to an interior portion of the compartment. The one end of the ribbon may be attached to a corner portion of the interior of the compartment, for example where the lateral top wall meets a side wall. The ribbon may then extend, from its point of attachment to the corner portion, along an interior surface of the lateral top wall, and then along an interior surface of the side wall opposite the corner where the attached end of the ribbon is attached. A free end of the ribbon may be graspable from outside the container.

Used consumer goods may be inserted into the container in the manner described above, and the distal ends of the used consumer goods will tend to push the ribbon towards the lateral top wall of the compartment. When a user wishes to remove used consumer goods from the container of the receptacle accessory, the user can grasp the free end of the ribbon and pull the free end away from the container. This will cause the ribbon to facilitate ejection of the used consumer goods from within the container, for example by pushing the used consumer goods out of their respective spaces. The ribbon can also help to remove any residual debris from the compartment that may have fallen out of the used consumer goods. A further advantage is that users do not have to touch the used consumer goods directly with their fingers.

The cap portion of the receptacle accessory may be disengaged from the lid portion of the package before the ribbon is pulled to facilitate ejections of the used consumer goods from the container.

Alternatively, the ribbon may be pulled while the cap portion of the receptacle accessory is still fitted on the lid portion of the package.

The compartment may be provided with a deodorising medium. The deodorising medium may comprise a lining or coating on the interior of the compartment, the lining or coating being impregnated with a deodorant. The coating may be a gel coating. Some used consumer goods, for example aerosol-generating articles that have been heated in a heating device, may have a residual odour that may be unwelcome in a user's pocket or handbag. The provision of a deodorising medium in the compartment may help to reduce such residual odours.

In embodiments provided with a ribbon, a deodorising medium may be incorporated in the ribbon. For example, the ribbon may be impregnated or coated with a deodorising medium. The free end of the ribbon may be free of deodorising medium so that the free end may be grasped by a consumer without transferring deodorising medium to the consumer's fingers.

The receptacle accessory may be made of suitable plastics materials.

According to a second aspect of the present invention, there is provided a system comprising a package for consumer goods having a body portion and a lid portion hingedly attached to the body portion along a hinge line, and a receptacle accessory according to the first aspect.

In some embodiments, the rear wall of the cap portion, when fitted on the lid portion of the package, does not cover the hinge line, thereby allowing the receptacle accessory to move with the lid portion when the lid portion is pivoted about the hinge line. Put another way, the rear wall of the cap portion, extending away from the top lateral wall of the cap portion, terminates at a position above the hinge line of the lid portion of the package. The lid portion of the package can be pivoted about the hinge line, together with the receptacle accessory, so as to allow access to fresh consumer goods in the package.

Alternatively, the rear wall of the cap portion, when the lid portion of the package is fully inserted into the cap portion of the receptacle accessory, may cover the hinge line. This may prevent the lid portion from pivoting about the hinge line, and can serve to lock the lid portion in a closed position. The cap portion of the receptacle accessory may be slidable relative to the lid portion of the package so as to expose the hinge line, thereby allowing the lid portion to pivot about the hinge line. A user can thus selectively lock and unlock the lid portion of the package by sliding the cap portion of the receptacle accessory between two positions relative to the lid portion of the package. This may be useful to prevent accidental opening of the package during transport in a user's pocket or handbag.

After a user has consumed all of the consumer goods in the package, and temporarily stored the used consumer goods in the container, the user may, at a convenient time, disengage the receptacle accessory from the empty package, eject all of the used consumer goods from the container for responsible disposal, and then fit the receptacle accessory to a fresh package of consumer goods. In this way, the receptacle accessory may be re-used many times.

In the present disclosure, the terms "side", "top", "bottom", "front", "rear" and similar terms are used to describe relative positions of components of the receptacle accessory and system. For example, a "front" wall of a given component refers to a wall that is opposite a "rear" wall of the same component.

The term "receptacle accessory" is used herein to define a device that is used as an accessory to a package of consumer goods, and includes a receptacle portion to receiving used consumer goods. The receptacle accessory may be manufactured, sold or distributed separately from packages of consumer goods, although it is conceivable that special packages of consumer goods may be sold together with a receptacle accessory.

The term "package for consumer goods" is used herein to define a generally box-shaped package having a body portion and a lid portion hingedly attached to the body portion along a hinge line. The lid portion may be opened by pivoting about the hinge line so as to allow access to an interior of the package and to consumer goods within the package. The lid portion is itself box-shaped, and may have a rectangular front wall, a rectangular rear wall, a rectangular lateral top wall and two opposing side walls. The opposing side walls may be rectangular, or the two opposing side walls may be trapezoidal. The lid portion may be hollow so as to fit over consumer goods stored vertically within the body portion of the package.

The term "consumer goods" is used herein to define goods that are presented to a consumer in the package, and which may be removed from the package by the consumer for enjoyment.

The term "used consumer goods" is used herein to define consumer goods that have been used or enjoyed by a consumer, and which the consumer wishes to dispose of or recycle in a responsible manner.

In certain embodiments, the term "consumer goods" refers particularly to heat-not-burn aerosol-generating articles that comprise an aerosol-generating substrate and other components that have been formed into a rod-shape and wrapped with a wrapping paper or another wrapping material.

The term "cap portion" is used herein to define a part of the receptacle accessory that is sized and shaped to receive and releasably retain the lid portion of the package of consumer goods by an interference fit. The cap portion may fit onto the lid portion in the manner of a cap.

The term "compartment" is used herein to define a part of the receptacle accessory that is configured to receive and retain used consumer goods. The compartment defines a volume for storing the used consumer goods. The compartment may be open on one or more sides so as to allow used consumer goods to be inserted into the compartment.

The term "longitudinal" is used herein to define a direction substantially parallel to a direction vertically downward from the lateral top wall of the cap portion or the lateral top wall of the compartment.

The term "deodorising medium" is used herein to define a medium that serves to mask or neutralise undesirable odours that may emanate from used consumer goods. The deodorising medium may release volatile odorant compounds or odorant-neutralizing compounds. The deodorising medium may be one or more of a gel, a solid, a liquid, a powder, a granular material. The deodorising medium may be coated on or impregnated in components of the receptacle accessory.

The term "ribbon" is use herein to define a flexible, longitudinally extending, substantially flat strip of material.

The invention is defined in the claims. However, below there is provided a non-exhaustive list of non-limiting examples. Any one or more of the features of these examples may be combined with any one or more features of another example, embodiment, or aspect described herein.

Example Ex1: A receptacle accessory for fitting on a package for consumer goods, the package having a body portion and a lid portion hingedly attached to the body portion, wherein the receptacle accessory comprises a cap portion configured to receive and releasably retain the lid portion of the package by an interference fit, the cap portion comprising a front wall, a rear wall and a lateral top wall connecting the front wall and the rear wall, and wherein the receptacle accessory further comprises a compartment configured to receive and retain used consumer goods, the compartment being disposed on a face of the front wall facing away from the rear wall.

Example Ex2: The receptacle accessory according to Example Ex1, wherein the cap portion further comprises at least one side wall connecting an end of the front wall to a corresponding end of the rear wall.

Example Ex3: The receptacle accessory according to Example Ex1, wherein the cap portion further comprises first and second side walls each connecting respective first and second ends of the front wall to corresponding first and second ends of the rear wall.

Example Ex4: The receptacle accessory according to any preceding Example, wherein the front wall of the cap portion extends further than the rear wall of the cap portion from the lateral top wall.

Example Ex5: The receptacle accessory according to any preceding Example, wherein the compartment has a rear wall formed by the front wall of the cap portion, a front wall, a lateral top wall connecting the rear wall and the front wall, and a pair of side walls, and wherein the compartment is open at a lower end to receive used consumer goods.

Example Ex6: The receptacle accessory according to any preceding Example, wherein the compartment is provided with a plurality of substantially parallel longitudinal ridges to define a plurality of substantially parallel spaces within the compartment.

Example Ex7: The receptacle accessory according to Example Ex6, wherein there is provided a concave arcuate surface between each adjacent pair of ridges.

Example Ex8: The receptacle accessory according to Example Ex6 or Ex7, wherein each space is configured to interference fit with a used consumer good when received in the space such that the used consumer good is securely held within the space.

Example Ex9: The receptacle accessory according to any one of Examples Ex6 to Ex8, wherein each space has a closed end proximate the lateral top wall of the cap portion, and wherein the closed end of each space is configured to hold a portion of a used consumer good in a substantially airtight manner.

Example Ex10: The receptacle accessory according to any one of Examples Ex6 to Ex9, wherein the ridges define at least 10 substantially parallel spaces within the compartment.

Example Ex11: The receptacle accessory according to any one of Examples Ex6 to Ex9, wherein the ridges define at least 20 substantially parallel spaces within the compartment.

Example Ex12: The receptacle accessory according to any one of Examples Ex6 to Ex11 depending from Example Ex5, wherein the ridges are provided on the rear wall of the compartment facing the front wall of the compartment.

Example Ex13: The receptacle accessory according to any one of Examples Ex6 to Ex11 depending from Example Ex5, wherein the ridges are provided on the front wall of the compartment facing the rear wall of the compartment.

Example Ex14: The receptacle accessory according to any one of Examples Ex6 to Ex11 depending from Example Ex5, wherein the ridges are provided on mutually facing surfaces of both the front wall and the rear wall of the compartment.

Example Ex15: The receptacle accessory according to any preceding Example, wherein at least one interior surface of the compartment is provided with a non-slip surface coating or non-slip surface features to help retain used consumer goods within the compartment.

Example Ex16: The receptacle accessory according to Example Ex15 depending from Examples Ex5 or Ex7, wherein the at least one interior surface of the compartment comprises at least one of an interior surface of the front wall, an interior surface of the rear wall, an interior surface of a side wall, and at least one of the concave arcuate surfaces.

Example Ex17: The receptacle accessory according to Example Ex15 or Ex16, wherein the non-slip surface coating is a coating having a friction coefficient higher than a friction coefficient of an exterior surface of the compartment.

Example Ex18: The receptacle accessory according to any one of Examples Ex15 to Ex17, wherein the non-slip surface features comprise a roughening or texturing of at least portions of the at least one interior surface so as to increase a friction coefficient of the interior surface.

Example Ex19: The receptacle accessory according to Example Ex5 or any one of Examples Ex6 to Ex18 depending from Example Ex5, wherein the front wall of the compartment extends further than the rear wall of the compartment from the lateral top wall.

Example Ex20: The receptacle accessory according to Example Ex5 or any one of Examples Ex6 to Ex18 depending from Example Ex5, wherein the front wall of the compartment extends substantially the same distance as the rear wall of the compartment from the lateral top wall.

Example Ex21: The receptacle accessory according to Example Ex5 or any one of Examples Ex6 to Ex20 depending from Example Ex5, wherein the front wall of the cap portion is the rear wall of the compartment.

Example Ex22: The receptacle accessory according to any preceding Example, wherein the compartment is provided with a ribbon configured to be pulled for facilitating ejection of used consumer goods from the compartment.

Example Ex23: The receptacle accessory according to any preceding Example, wherein the compartment is provided with a deodorising medium.

Example Ex24: The receptacle accessory according to Example Ex23 depending from Example Ex22, wherein the deodorising medium is incorporated into the ribbon.

Example Ex25: The receptacle accessory according to any preceding Example, wherein at least one interior surface of the cap portion is provided with a non-slip surface coating or non-slip surface features to help improve the interference fit between the interior surface of the cap portion and an exterior surface of the lid portion.

Example Ex26: The receptacle accessory according to Example Ex25, wherein the at least one interior surface comprises at least one of an interior surface of the front wall, an interior surface of the rear wall, an interior surface of a side wall, or interior surfaces of any combination of the front wall, the rear wall and the side wall(s).

Example Ex27: The receptacle accessory according to Example Ex25 or Ex26, wherein the non-slip surface coating is a coating having a friction coefficient higher than a friction coefficient of an exterior surface of the receptacle accessory.

Example Ex28: The receptacle accessory according to any one of Examples Ex25 to Ex27, wherein the non-slip surface features comprise a roughening or texturing of at least portions of the interior surface so as to increase a friction coefficient of the interior surface.

Example Ex29: A system comprising a package for consumer goods having a body portion and a lid portion hingedly attached to the body portion along a hinge line, and a receptacle accessory according to any one of Examples Ex1 to 28.

Example Ex30: The system according to Example Ex29, wherein the rear wall of the cap portion, when fitted on the lid portion of the package, does not cover the hinge line, thereby allowing the receptacle accessory to move with the lid portion when the lid portion is pivoted about the hinge line.

Example Ex31: The system according to Example Ex29, wherein the rear wall of the cap portion, when the lid portion of the package is fully inserted into the cap portion of the receptacle accessory, covers the hinge line, thereby preventing the lid portion from pivoting about the hinge line, and wherein the cap portion of the receptacle accessory is slidable relative to the lid portion of the package so as to expose the hinge line and to allow the lid portion to pivot about the hinge line.

Examples will now be further described with reference to the figures in which.

Figure 1:
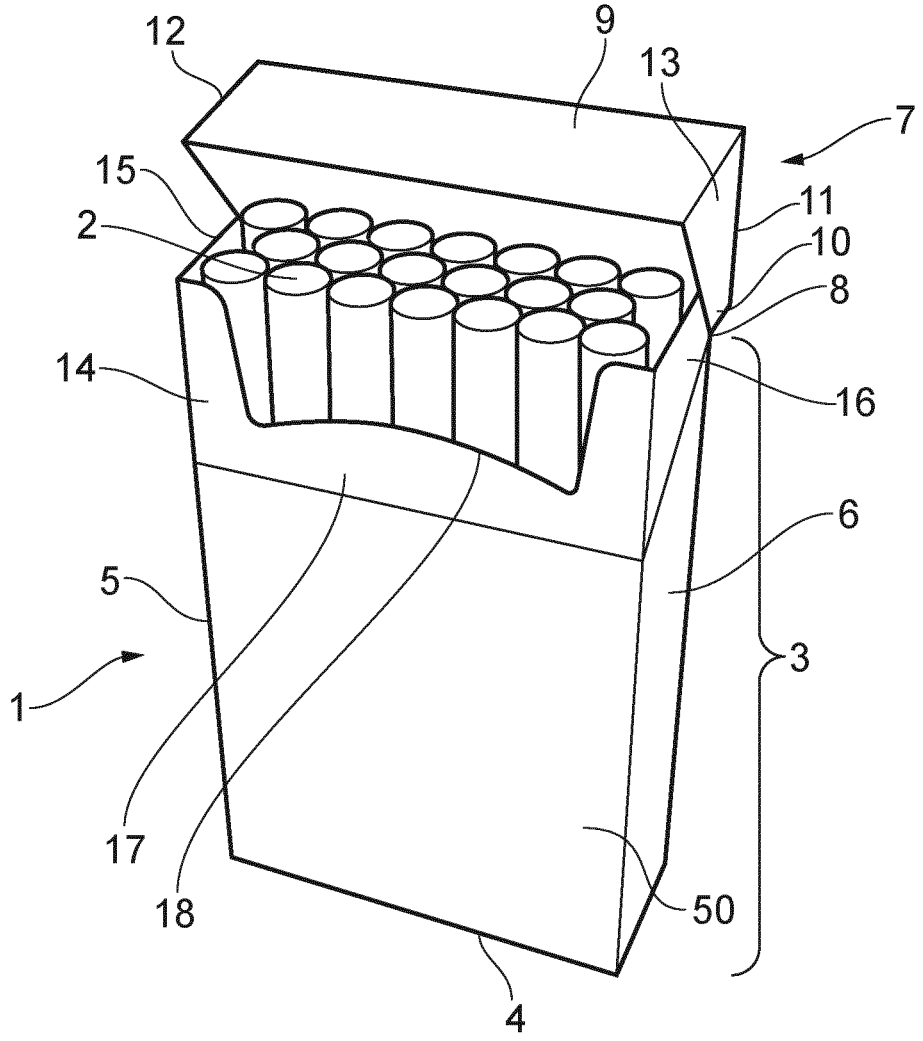
FIG. 1 shows a package of consumer goods.

FIG. 1 shows a package 1 of consumer goods 2. The package 1 is made of cardboard. The package 1 has a body portion 3 comprising a front wall 50, a bottom 4, a left mitre panel 5, a right mitre panel 6 and a rear wall (not visible in FIG. 1). The body portion 3 is hollow, and defines a volume in which the consumer goods 2 are stored. A lid portion 7 is hingedly attached to the body portion 3 along a hinge line 8 formed along the top of the rear wall of the package 1. The lid portion 7 has a rectangular front wall 9, a rectangular rear wall 10, a rectangular lateral top wall 11 and left and right opposing side walls 12, 13. The left and right opposing side walls 12, 13 in the illustrated embodiment are trapezoidal, such that a bottom edge of each side wall 12, 13 aligns with a top edge of the respective mitre panel 5, 6 of the body portion 3 when the lid portion 7 is closed. The lid portion 7 is hollow so as to fit over consumer goods 2 stored vertically within the body portion 3 of the package 1. An inner frame 14, also made of cardboard, is provided inside the body portion 3. The inner frame 14 has left and right side walls 15, 16, a front wall 17 and an optional rear wall (not visible in FIG. 1). The front wall 17 of the inner frame 14 has a cut-out portion 18 to facilitate access to the consumer goods 2 when the lid portion 7 is open. The inner frame 14 helps to provide structural stability to the package 1, with the side walls 15, 16 and edge portions of the front wall 17 fitting inside the lid portion 7 when the lid portion 7 is closed. The inner frame 14 can help to guide the lid portion 7 between open and closed positions.

Figure 2:
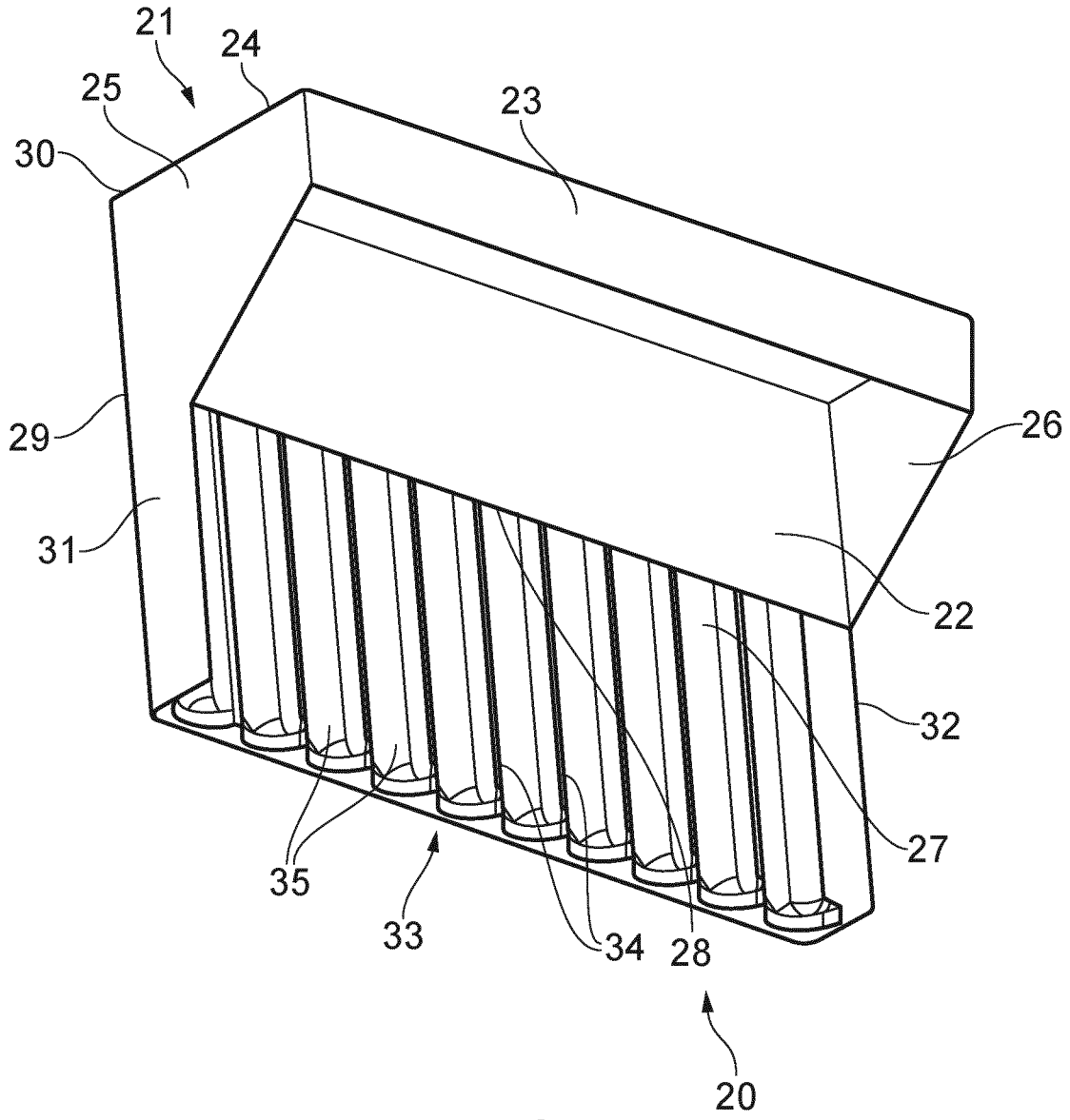
FIG. 2 shows a receptacle accessory.

FIG. 2 shows a receptacle accessory 20 having a cap portion 21. The cap portion 21 comprises a front wall 22, a rear wall 23 and a lateral top wall 24 connecting the front wall 22 to the rear wall 23. In the embodiment shown in FIG. 2, the cap portion 21 also comprises first and second side walls 25, 26 each connecting one end of the front wall 22 to a corresponding end of the rear wall 23. However, in other embodiments (not shown), one or both of the side walls 25, 26 may be omitted.

In the embodiment of FIG. 2, the cap portion 21 has a shape and configuration that is generally similar to the shape and configuration of the lid portion 7 of the package 1 of FIG. 1. The cap portion 21 is sized and configured to receive and releasably retain the lid portion 7 of the package 1 by an interference fit. In the illustrated embodiment, the side walls 25, 26 of the cap portion 21 are trapezoidal and similar in shape to the trapezoidal side walls 12, 13 of the package 1 illustrated in FIG. 1. In the illustrated embodiment, the front wall 22 of the cap portion 21 extends further than the rear wall 23 from the lateral top wall 24.

The receptacle accessory 20 further comprises a compartment 27 configured to receive and retain used consumer goods (not shown in FIG. 2). The used consumer goods are the consumer goods 2 shown in FIG. 1 after they have been removed from the package 1 and enjoyed by a consumer. The compartment 27 is disposed on a face of the front wall 22 of the cap portion 21 facing away from the rear wall 23 of the cap portion 21.

The compartment 27 in the embodiment illustrated in FIG. 2 has a rear wall 28 formed by the front wall 22 of the cap portion 21, a front wall 29 and a lateral top wall 30 connecting the rear wall 28 and the front wall 29. The lateral top wall 30 of the compartment 27 in this embodiment is a simple extension of the lateral top wall 24 of the cap portion 21. The compartment 27 further comprises first and second side walls 31, 32. The compartment 27 is open at a lower end 33 to receive used consumer goods.

In the embodiment shown in FIG. 2, the compartment 27 is provided with a plurality of substantially parallel longitudinal ridges 34. The ridges 34 define a plurality of substantially parallel spaces 35 within the compartment 27. Each space 35 may be configured to interference fit with a used consumer good when received in the space 35 such that the used consumer good is securely held within the space 35.

In the embodiment shown in FIG. 2, each space 35 has a closed end proximate the lateral top wall 24 of the cap portion 21. The closed end of each space 35 is also proximate the lateral top wall 30 of the compartment 27. The closed end of each space 35 is bounded by the rear wall 28, the front wall 29 and the lateral top wall 30 of the compartment. The spaces 35 at left and right sides of the compartment 27 are also bounded by the side walls 31, 32 of the compartment 27. The closed ends of the spaces 35 may be configured to hold portions of used consumer goods in a substantially airtight manner. For example, where the used consumer goods are used aerosol-generating articles, such as used rod-shaped heat-not-burn aerosol-generating articles comprising an aerosol-generating substrate towards one longitudinal end and a filter portion at an opposed longitudinal end, the used consumer goods may be inserted into the spaces 35 such that the used aerosol-generating substrate end of each consumer good is contained within the closed end of each space 35. The filter portion end of each consumer good can then act as a plug at an opening of the closed end of the respective space 35. In this way, the used aerosol-generating substrate portions of each used consumer good may be contained within the closed ends of the spaces so as to reduce the emission of unwanted odours from the compartment 27.

Figure 3:
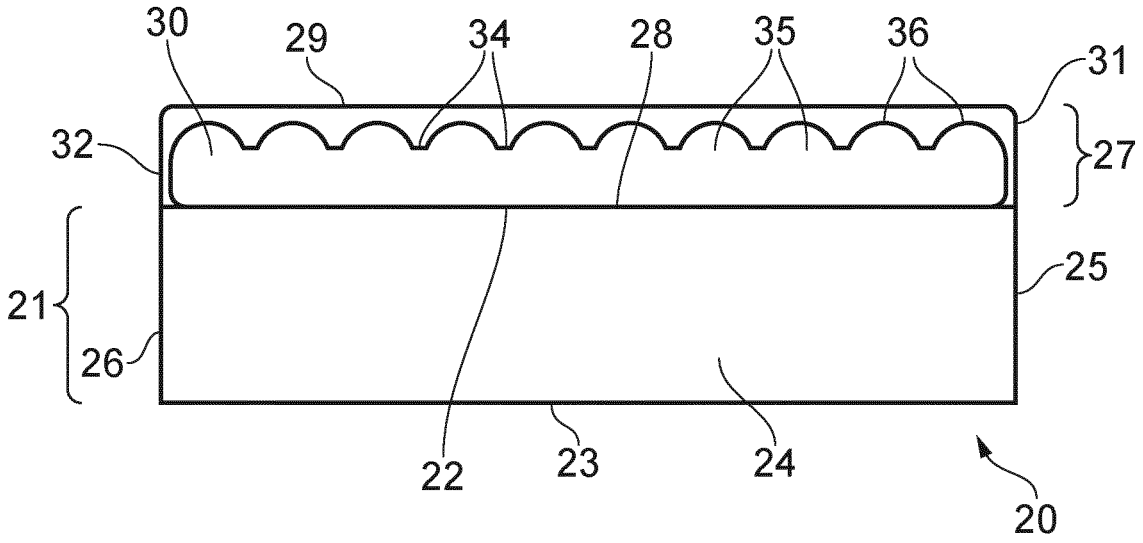
FIG. 3 shows a bottom plan view of the receptacle accessory of FIG. 2.

FIG. 3 shows a bottom plan view of the receptacle accessory 20 shown in FIG. 2, with like parts being labelled as in FIG. 2. FIG. 3 more clearly shows the relationship between the front wall 22 and rear wall 23 of the cap portion 21, the front wall 29 and rear wall 28 of the compartment 27, the side walls 25, 26 of the cap portion 21, and the side walls 31, 32 of the compartment 27. In the illustrated embodiment, the longitudinal ridges 34 or provided on an inner surface of the front wall 29 of the compartment 27, facing the rear wall 28 of the compartment 27. In alternative embodiments, the longitudinal ridges 34 may be provided on an inner surface of the rear wall 28 of the compartment 27, facing the front wall 29 of the compartment. In some embodiments, the longitudinal ridges 34 may be provided on facing surfaces of both the rear wall 28 and the front wall 29 of the compartment 27. In these embodiments, it is preferable that the longitudinal ridges 34 are in registration with each other on opposite sides of the compartment 27, thereby to define the spaces 35.

A concave arcuate surface 36 may be provided between each pair of adjacent longitudinal ridges 34. The concave arcuate surface 36 may be shaped as an arc of a cylinder. The shape of the concave arcuate surface 36 may be selected to be complementary to a cylindrical shape of used consumer goods, thereby better to retain the used consumer goods in the spaces 35 so that the used consumer goods do not easily fall out of the compartment 27. The concave arcuate surfaces 36, in combination with the longitudinal ridges 34 and the opposing wall of the compartment 27, provide an interference fit with used consumer goods inserted into the spaces 35.

At least one interior surface of the compartment 27, for example an interior surface of at least one of the front wall 29, the rear wall 28, the side walls 31, 32 and the concave arcuate surfaces 36 may be provided with a non-slip surface coating or non-slip surface features to help retain used consumer goods within the compartment 27. The non-slip surface coating may be a coating having a friction coefficient higher than a friction coefficient of an exterior surface of the compartment 27. Non-slip surface features may comprise a roughening or texturing of at least portions of the at least one interior surface so as to increase a friction coefficient of the interior surface of the compartment 27.

Because used consumer goods are stored within the compartment 27, but outside of the package 1 of unused consumer goods 2, it is desirable that the used consumer goods do not easily fall out of the compartment 27 while the package 1 with the attached receptacle accessory 20 is being carried in a pocket or handbag.

In the embodiment illustrated in FIG. 2, the front wall 29 of the compartment 27 extends further than the rear wall 28 of the compartment 27 from the lateral top wall 30. This means that lower portions of the spaces 35 are exposed in a direction that faces the front wall 50 of the body portion 3 of the package 1 when the receptacle accessory 20 is fitted on the lid portion 7 of the package 1 and the lid portion 7 is closed. When the lid portion 7 is opened by pivoting about the hinge line 8, the spaces 35 move away from the front wall 50 of the body portion 3 of the package 1. However, since at least portions of the used consumer goods are retained within the closed ends of the spaces 35 by an interference fit, the used consumer goods will not fall out of the compartment 27 when the lid portion 7 is opened.

In alternative embodiments (not shown), the rear wall 28 of the compartment 27 (and the front wall 22 of the cap portion 21) extends substantially the same distance as the front wall 29 of the compartment 27 from the lateral top wall 30. In these embodiments, lower portions of the spaces 34 are enclosed by the rear wall 28 and the front wall 29 of the compartment 27, other than at the bottom end of the compartment 27. Although these alternative embodiments do not allow used consumer goods to be ejected from the compartment 27 as easily, they may help better to retain the used consumer goods within the compartment as a result of an increased interference fit.

The embodiment shown in FIGS. 2 and 3 has ten spaces 35 defined by nine longitudinal ridges 34. This embodiment is particularly suited for use with packages 1 containing ten consumer goods. The receptacle accessory 20 is thus configured to hold the same number of used consumer goods as there are fresh consumer goods 2 in the package 1. In other embodiments, there may be twenty spaces defined by nineteen longitudinal ridges 34. These embodiments are particularly suited for use with packages 1 containing twenty consumer goods. In embodiments where longitudinal ridges 34 are provided on interior surfaces of both the front wall 29 and the rear wall 28 of the compartment 27, ten spaces 35 may be defined by eighteen longitudinal ridges, and twenty spaces 35 may be defined by thirty eight longitudinal ridges 34. The number of spaces 35 and ridges 34 may be generalised as required.

At least one interior surface of the cap portion 21 of the embodiments shown in FIGS. 1 and 2 may be provided with a non-slip surface coating or non-slip surface features to help improve the interference fit between the interior surface of the cap portion 21 and an exterior surface of the lid portion 7 of the package 1. The at least one interior surface of the cap portion 21 may comprise at least one of an interior surface of the front wall 22, an interior surface of the rear wall 23, an interior surface of a side wall 25, 26, or interior surfaces of any combination of the front wall 22, the rear wall 23 and the side wall(s) 25, 26. The non-slip surface coating may be a coating having a friction coefficient higher than a friction coefficient of an exterior surface of the receptacle accessory 20. The non-slip surface features may comprise a roughening or texturing of at least portions of the interior surface so as to increase a friction coefficient of the interior surface of the cap portion 21. Such non-slip surface coatings or surface features can help to prevent the receptacle accessory 20 from becoming accidentally separated from the package 1 when carried in a pocket or handbag.

In the embodiment shown in FIG. 2, the front wall 22 of the cap portion 21 extends further than the rear wall 23 from the lateral top wall 24. A lower edge of the rear wall 23 of the cap portion 21, when fitted on the lid portion 7 of the package 1, may be located above the hinge line 8 of the package 1. In other words, the rear wall 23 of the cap portion 21 does not cover or extend over the hinge line 8 of the package 1 when the lid portion 7 of the package 1 is fully received in the cap portion 21. This allows the lid portion 7 to be opened without hindrance, since the lid portion 7 and the rear wall 23 of the cap portion 21 can both pivot together about the hinge line 8.

In other embodiments, a lower edge of the rear wall 23 of the cap portion 21, when the lid portion 7 is fully received in the cap portion 21, may be located below the hinge line 8. In other words, the rear wall of the cap portion 21 may cover or extend over the hinge line 8 of the package 1 when the lid portion 7 of the package 1 is fully received in the cap portion 21. This prevents the lid portion 7 from being pivoting freely about the hinge line 8, and can serve to lock the lid portion 7 in a closed position. If a consumer wishes to unlock the lid portion 7, the receptacle accessory 20 may be slid upwardly relative to the package 1 until the hinge line 8 is exposed or no longer covered by the rear wall 23 of the cap portion 21, thus allowing the lid portion 7 to pivot freely about the hinge line 8. Being able to lock the lid portion 7 in this way may be desirable so as to prevent unwanted opening of the package 1 during transport in a pocket or handbag.

The compartment 27 may be provided with a deodorising medium. The deodorising medium may comprise a lining or coating on the interior of the compartment 27, the lining or coating being impregnated with a deodorant. The coating may be a gel coating. Some used consumer goods, for example aerosol-generating articles that have been heated in a heating device, may have a residual odour that may be unwelcome in a user's pocket or handbag. The provision of a deodorising medium in the compartment 27 may help to reduce such residual odours.

Figure 4:
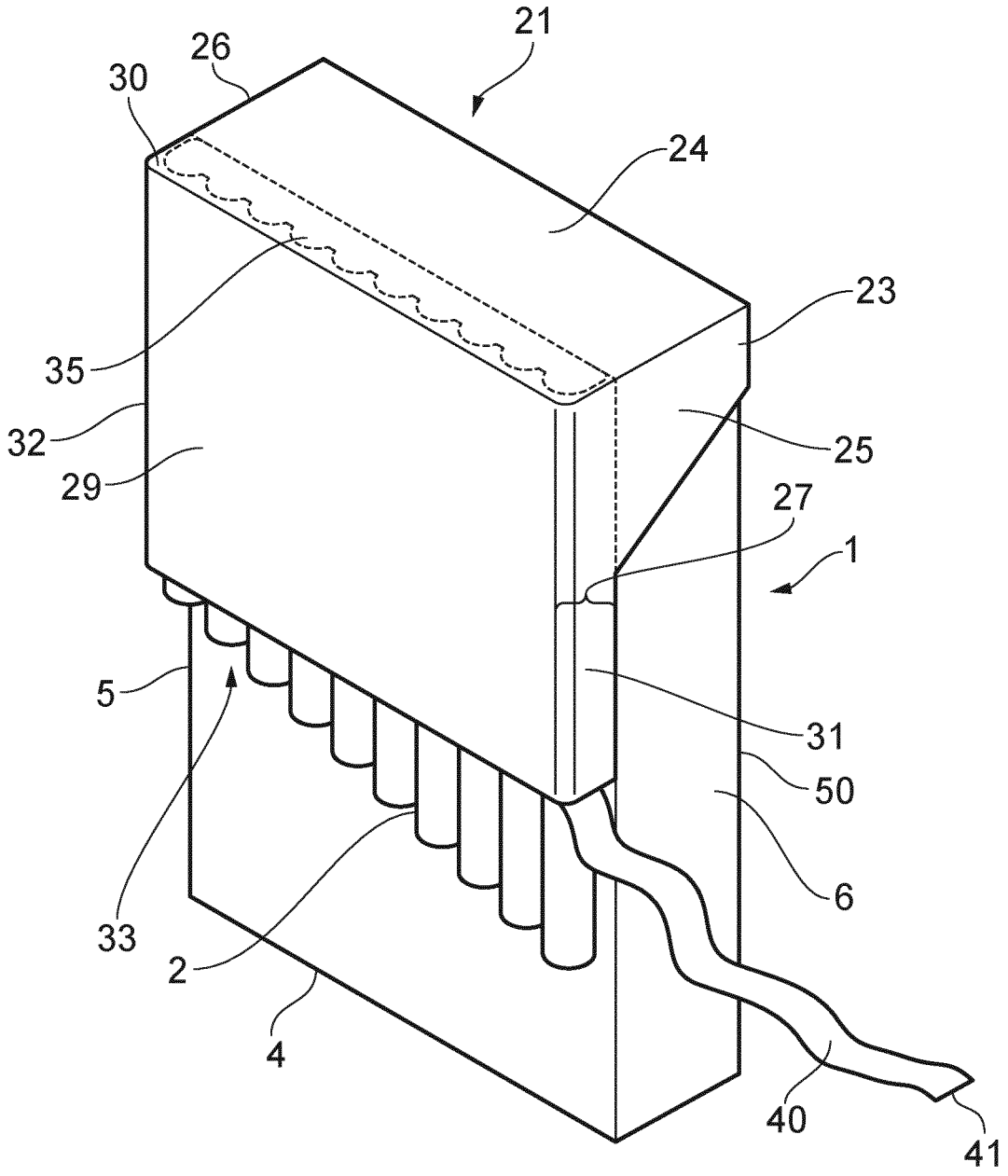
FIG. 4 shows a receptacle accessory having a ribbon to facilitate ejection of used consumer goods, the receptacle accessory being fitted on a package of consumer goods.

FIG. 4 shows an embodiment in which the compartment 27 is provided with a ribbon 40 configured to be pulled for facilitating ejection of used consumer goods from the compartment 27. The ribbon 40 may be made of a flexible polymer material, or may comprise woven or non-woven threads or fibres, for example of cotton or synthetic polymer. In some embodiments, the ribbon 40 may be made of cellulosic fibres. The ribbon 40 is flexible. Preferably, the ribbon 40 is substantially inelastic in a longitudinal direction. In other words, the ribbon 40 preferably does not stretch appreciably when pulled. One end of the ribbon 40 is attached to an interior surface of the compartment 27. The end of the ribbon 40 may be attached at or close to a corner portion of the interior of the compartment 27, for example where the lateral top wall 30 meets a side wall 31, 32. A length of the ribbon 40 may then lie generally within the compartment 27, and a free end 41 of the ribbon 40 may project from the compartment 27 or be graspable from outside the compartment 27. As the compartment 27 is sequentially filled with used consumer goods, the ribbon 40 will be constrained between distal ends of the used consumer goods and the interior surface of the lateral top wall 30 of the compartment 27, although the free end 41 will remain graspable from outside the container 27. When a consumer wishes to eject used consumer goods from the compartment 27 (this may be done when the compartment 27 is filled or when the compartment 27 is only partially filled), the consumer grasps the free end 41 of the ribbon 40 and pulls in a direction away from the lateral top wall 30. Tension in the ribbon 40 will then help to pull the used consumer goods out of the compartment 27 for responsible disposal. The ribbon 40 may also facilitate ejection of any debris that may have been deposited in the compartment from the used consumer goods, for example crumbs or particles of used aerosol-generating substrate. Provision and use of a ribbon 40 allows the used consumer goods to be ejected quickly and easily, without the need to touch or handle the used consumer goods directly with the consumer's fingers.

The ribbon 40 may incorporate a deodorising medium. The ribbon 40 may be impregnated or coated with a deodorising medium. The free end 41 of the ribbon 40 may be free of deodorising medium so that the free end 41 may be grasped by a consumer without transferring deodorising medium to the consumer's fingers.

Figure 5:
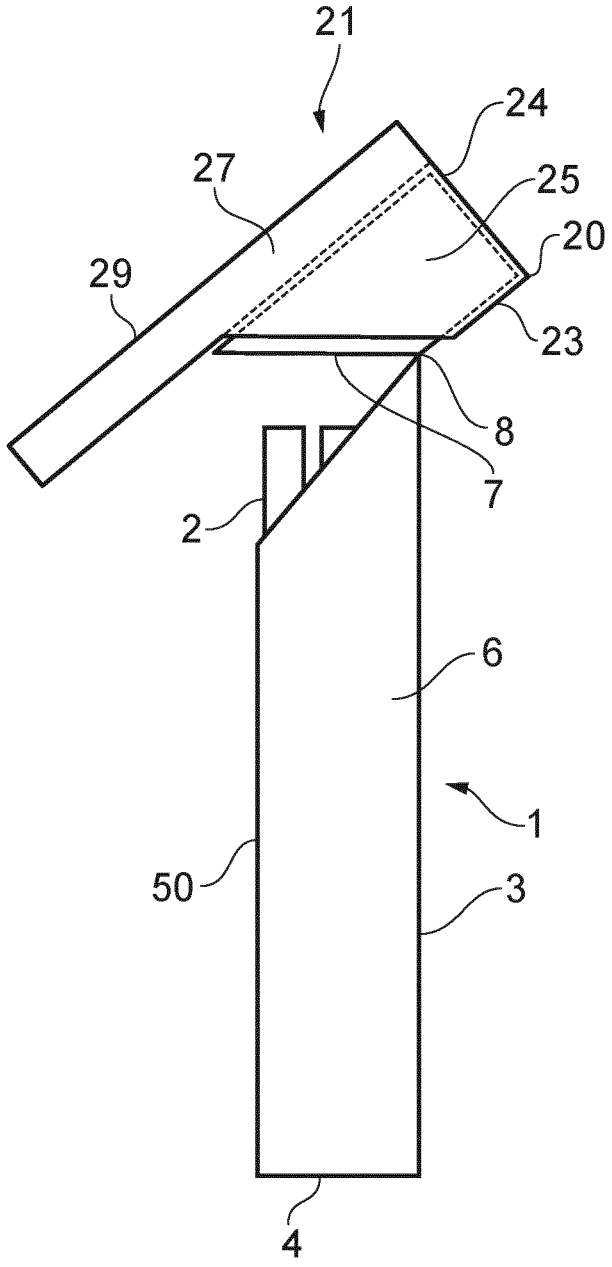
FIG. 5 shows a side view of a receptacle accessory fitted on a package of consumer goods in a partially open configuration.

FIG. 5 shows a side view of an embodiment comprising the package 1 of consumer goods 2 as shown in FIG. 1 fitted with a receptacle accessory 20 as shown in FIG. 2. The lid portion 7 of the package 1 is joined to the body portion 3 by the hinge line 8. The cap portion 21 of the receptacle accessory 20 fits over the lid portion 7 of the package 1. The rear wall 23 of the cap portion 21 does not cover the hinge line 8, thus allowing the lid portion 7 and the receptacle accessory 20 to pivot about the hinge line 8 as shown, giving access to the consumer goods 2 in the package 1.

The invention claimed is:

1. A receptacle accessory for fitting on a package for consumer goods, the package having a body portion and a lid portion hingedly attached to the body portion, the receptacle accessory comprising:

a cap portion configured to receive and releasably retain the lid portion of the package by an interference fit, wherein the cap portion comprises a front wall, a rear wall, and a lateral top wall connecting the front wall and the rear wall; and a compartment configured to receive and retain used consumer goods, the compartment being disposed on a face of the front wall facing away from the rear wall.

2. The receptacle accessory according to claim 1, wherein the cap portion further comprises at least one side wall connecting an end of the front wall to a corresponding end of the rear wall.

3. The receptacle accessory according to claim 1, wherein the front wall of the cap portion extends further than the rear wall of the cap portion from the lateral top wall.

4. The receptacle accessory according to claim 1, wherein the compartment has a rear wall formed by the front wall of the cap portion, a front wall, a lateral top wall connecting the rear wall and the front wall, and a pair of side walls, and wherein the compartment is open at a lower end to receive used consumer goods.

5. The receptacle accessory according to claim 1, wherein the compartment is provided with a plurality of substantially parallel longitudinal ridges to define a plurality of substantially parallel spaces within the compartment.

6. The receptacle accessory according to claim 5, wherein a concave arcuate surface is provided between each adjacent pair of the substantially parallel longitudinal ridges.

7. The receptacle accessory according to claim 5, wherein each space is configured to interference fit with a used consumer good when received in the space such that the used consumer good is securely held within the space.

8. The receptacle accessory according to claim 5, wherein the compartment has a rear wall formed by the front wall of the cap portion, a front wall, a lateral top wall connecting the rear wall and the front wall, and a pair of side walls, wherein the compartment is open at a lower end to receive used consumer goods, and wherein the substantially parallel longitudinal ridges are provided on the front wall of the compartment facing the rear wall of the compartment.

9. The receptacle accessory according to claim 5, wherein the compartment has a rear wall formed by the front wall of the cap portion, a front wall, a lateral top wall connecting the rear wall and the front wall, and a pair of side walls, wherein the compartment is open at a lower end to receive used consumer goods, and wherein the front wall of the compartment extends further than the rear wall of the compartment from the lateral top wall.

10. The receptacle accessory according to claim 1, wherein at least one interior surface of the compartment is provided with a non-slip surface coating or non-slip surface features configured to help retain used consumer goods within the compartment.

11. The receptacle accessory according to claim 1, wherein the compartment is provided with a ribbon configured to be pulled for facilitating ejection of used consumer goods from the compartment.

12. The receptacle accessory according to claim 1, wherein the compartment is provided with a deodorising medium.

13. A system comprising a package for consumer goods having a body portion and a lid portion hingedly attached to the body portion along a hinge line, and a receptacle accessory according to claim 1.

14. The system according to claim 13, wherein the rear wall of the cap portion, when fitted on the lid portion of the package, does not cover the hinge line, thereby allowing the receptacle accessory to move with the lid portion when the lid portion is pivoted about the hinge line.

15. The system according to claim 13, wherein the rear wall of the cap portion, when the lid portion of the package is fully inserted into the cap portion of the receptacle accessory, covers the hinge line, thereby preventing the lid portion from pivoting about the hinge line, and wherein the cap portion of the receptacle accessory is slidable relative to the lid portion of the package so as to expose the hinge line and to allow the lid portion to pivot about the hinge line.

* * * * *